US009117330B2

(12) United States Patent
Stevens et al.

(10) Patent No.: US 9,117,330 B2
(45) Date of Patent: Aug. 25, 2015

(54) GAMING SYSTEM AND A METHOD OF GAMING

(75) Inventors: Christopher Michael Stevens, Lane Cove (AU); Ryan Paul Hawkins, Coffs Harbour (AU)

(73) Assignee: Aristocrat Technologies Australia Pty Limited (AU)

( * ) Notice: Subject to any disclaimer, the term of this patent is extended or adjusted under 35 U.S.C. 154(b) by 837 days.

(21) Appl. No.: 11/832,325

(22) Filed: Aug. 1, 2007

(65) Prior Publication Data

US 2008/0108414 A1 May 8, 2008

(30) Foreign Application Priority Data

Aug. 1, 2006 (AU) ..... 2006904146

(51) Int. Cl.
*A63F 9/24* (2006.01)
*G07F 17/32* (2006.01)

(52) U.S. Cl.
CPC ..... *G07F 17/32* (2013.01); *G07F 17/3244* (2013.01); *G07F 17/326* (2013.01)

(58) Field of Classification Search
CPC .... G07F 17/32; G07F 17/326; G07F 17/3244
USPC ..... 463/16–20
See application file for complete search history.

(56) References Cited

U.S. PATENT DOCUMENTS 5,954,336 A * 9/1999 Goossens et al. ..... 273/309
6,213,876 B1 * 4/2001 Moore, Jr. ..... 463/22
6,638,165 B2 * 10/2003 Uchiyama et al. ..... 463/20
6,656,046 B1 * 12/2003 Yoseloff et al. ..... 463/20
2004/0219968 A1 11/2004 Fiden et al.
2005/0020344 A1 1/2005 Kaminkow
2006/0068881 A1 * 3/2006 Casey ..... 463/20
2006/0121974 A1 6/2006 Rodgers et al.
2006/0160613 A1 7/2006 Hornik et al.
2007/0021180 A1 * 1/2007 Osawa ..... 463/16
2010/0105468 A1 * 4/2010 Sugano ..... 463/25

FOREIGN PATENT DOCUMENTS

EP 950998 10/1999
WO WO9732285 9/1997
WO 01/89647 11/2001
WO WO0189647 11/2001

OTHER PUBLICATIONS

Examination Report corresponding to New Zealand Patent Application No. 560356, dated Aug. 8, 2007, 2 pages.

* cited by examiner

*Primary Examiner* — Michael Cuff
(74) *Attorney, Agent, or Firm* — McAndrews, Held & Malloy, Ltd.

(57) ABSTRACT

A gaming system is disclosed which is arranged to randomly display a plurality of symbols from a set of symbols. The gaming system comprises a function allocator arranged to allocate a function to at least one symbol selected from the set of symbols, and a game outcome generator arranged to determine a game outcome based on the displayed symbols and on the function allocated to the selected symbol. A corresponding method, computer program and computer readable medium having computer readable program code embodied therein are also disclosed.

50 Claims, 7 Drawing Sheets

GAMING SYSTEM AND A METHOD OF GAMING

CROSS REFERENCE TO RELATED APPLICATIONS

This application claims priority to Australian Patent Application No. AU2006904146, having an international filing date of Aug. 1, 2006, entitled "A Gaming System and a Method of Gaming", which is hereby incorporated by reference herein in its entirety.

FIELD OF THE INVENTION

The present invention relates to a gaming system and to a method of gaming.

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

While such gaming systems are popular with game players, the ability to modify characteristics of a game and thereby enhance player amusement is limited because the set of symbols is fixed. Indeed, in some jurisdictions in order to comply with gaming regulations it is necessary to keep the reel strip lengths and symbols constant.

SUMMARY OF THE INVENTION

In accordance with a first aspect of the present invention, there is provided a gaming system arranged to randomly display a plurality of symbols from a set of symbols, the gaming system comprising:

a function allocator arranged to allocate a function to at least one symbol selected from the set of symbols; and a game outcome generator arranged to determine a game outcome based on the displayed symbols and on the function allocated to the selected symbol.

In one arrangement, the function allocator is arranged to allocate a function to at least one symbol selected from the plurality of displayed symbols.

In one embodiment, the gaming system comprises a player operable interface and a symbol selector arranged to facilitate selection of a symbol by a player using the interface.

In an alternative embodiment, the gaming system comprises a symbol selector arranged to automatically select a symbol. Automatic selection of a symbol by the symbol selector may be random or in accordance with a predefined sequence.

In one embodiment, selection of a symbol is communicated to a player by separately displaying the selected symbol.

In an alternative embodiment, the symbols comprise a plurality of standard symbols with at least one of the standard symbols having an incorporated special symbol, and the function allocator is arranged to allocate a function to a standard symbol incorporating the selected special symbol when the special symbol is separately displayed.

With this embodiment, a special symbol may be incorporated into a standard symbol as a background symbol, as a superimposed symbol, as a double symbol, or by alternately displaying the standard symbol and the special symbol.

The incorporated special symbol may be a number. With this embodiment, allocation of a new function to a symbol may be communicated to a player by displaying a number, which may be pseudo randomly selected, and the function allocator may be arranged to allocate a function to all symbols which have a number which accords to a particular relationship. The relationship may be that the displayed number is the same, greater than, or less than the number incorporated into the symbol.

In a further alternative embodiment, selection of a symbol may be communicated to a player by modifying the appearance of a symbol, such as by animating the symbol or changing the colour of the symbol.

The gaming system may comprise a plurality of rotatable physical reels or a plurality of virtual reels displayable on a graphical display device, with each reel including a plurality of associated symbols.

In an implementation which includes a plurality of rotatable physical reels, selection of a symbol may be communicated to a player by emphasising a displayed symbol, such as by illuminating the displayed symbol at an increased intensity relative to other displayed symbols, or by illuminating a selected symbol with light of a different colour to other displayed symbols.

It will also be understood that a function may be allocated to a selected symbol for one game, with the symbol returning to its normal significance for subsequent games, or the function may by allocated to a selected symbol for multiple successive games.

In a further alternative embodiment, the gaming system is arranged to facilitate selection of a symbol by an external system in communication with the gaming system, or by another player.

In one arrangement, the gaming system is arranged to select a symbol and to allocate a function to the selected symbol when a predefined trigger condition exists, which may be display of a predefined other symbol, or display of graphical indicia, for example a representation of a woman, which may occur pseudo randomly. The predefined other symbol may be a function symbol and the gaming system may be arranged to allocate the function associated with the function symbol to the selected symbol when the function symbol is displayed. If more than one other symbol or if multiple graphical indicia appear on the display, a function may be allocated to a selected symbol for each displayed other symbol or graphical indicia.

In one embodiment, the gaming system is operable in normal game mode and special game mode and the function allocator is arranged to allocate a function to a selected symbol only when the gaming system is operating in the special game mode. The gaming system may be arranged to commence special game mode either automatically or in response to player input when a predetermined game outcome occurs. Special game mode may comprise 3 games.

In one arrangement, the gaming system is arranged to select a plurality of symbols and the function allocator is arranged to allocate a function to each symbol. The symbols may be disposed in a plurality of reels and symbols in one or more reels may be selected. In one variation, the number of symbols selected may progressively increase with successive games. In another variation, successive allocated functions may be different.

The function allocated to a symbol may be a wild function, a scatter function, a repeat win function, a multiplier function, a jackpot function or a feature commencement function.

The gaming system may be implemented as a stand alone gaming machine or across a network.

In accordance with a second aspect of the present invention, there is provided a method of gaming comprising:

providing a set of symbols;

randomly displaying a plurality of symbols from the set of symbols;

allocating a function to a selected symbol from the set of symbols; and determining a game outcome based on the displayed symbols and on the function allocated to the selected symbol.

In accordance with a third aspect of the present invention, there is provided a computer program arranged when loaded into a computer to instruct the computer to operate in accordance with a gaming system arranged to randomly display a plurality of symbols from a set of symbols, the gaming system comprising:

a function allocator arranged to allocate a function to at least one symbol selected from the set of symbols; and a game outcome generator arranged to determine a game outcome based on the displayed symbols and on the function allocated to the selected symbol.

In accordance with a fourth aspect of the present invention, there is provided a computer readable medium having computer readable program code embodied therein for causing a computer to operate in accordance with a gaming system arranged to randomly display a plurality of symbols from a set of symbols, the gaming system comprising:

a function allocator arranged to allocate a function to at least one symbol selected from the set of symbols; and a game outcome generator arranged to determine a game outcome based on the displayed symbols and on the function allocated to the selected symbol.

BRIEF DESCRIPTION OF THE DRAWINGS

The present invention will now be described, by way of example only, with reference to the accompanying drawings, in which.

DESCRIPTION OF AN EMBODIMENT OF THE INVENTION

Figure 1:
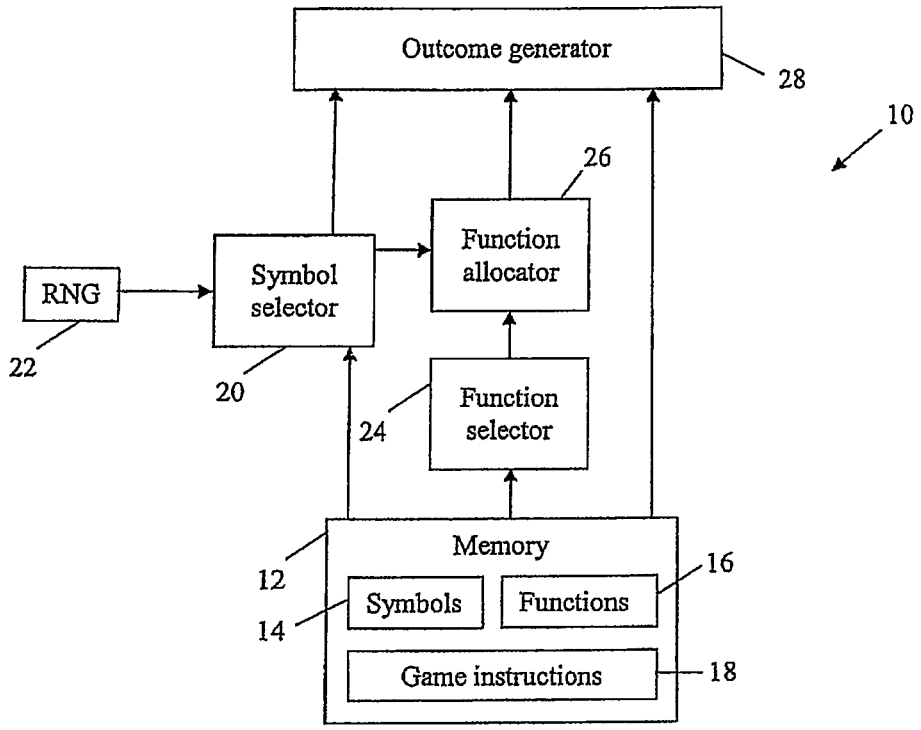
FIG. 1 is a diagrammatic block diagram of a gaming system in accordance with an embodiment of the present invention.

Referring to the drawings, there is shown a gaming system 10 arranged to implement a probabilistic game of the type wherein several symbols from a set of symbols are randomly displayed and a game outcome is determined on the basis of the displayed symbols. With some such probabilistic games, the set of symbols include standard symbols at least one of which is a function symbol, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that one or more function symbols can effectively be added during a game so as to modify the probability of occurrence of a win outcome and thereby enhance player interest in playing the game. This is achieved by selecting one or more symbols to acquire a new function and determining game outcomes based on displayed symbols and the new function. The function acquired by a symbol may be in place of or in addition to any function already associated with the symbol.

Referring to FIG. 1, the gaming system 10 comprises a memory 12 arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

The gaming system 10 also includes a symbol selector 20 which is arranged to select several symbols for display to a player and in some game circumstances to select one or more symbol to which a function is to be allocated. In this example, the selection carried out by the symbol selector 20 is made using a random number generator 22.

It will be appreciated that the random number generator 22 may be of a type which is arranged to generate pseudo random numbers based on a seed number, and that in this specification the term "random" will be understood accordingly to mean truly random or pseudo random.

The gaming system 10 also comprises a function selector 24 arranged to select one or more functions for allocation to one or more symbols selected during the special game circumstances, and a function allocator 26 arranged to allocate the or each function selected by the function selector 24 to one or more symbols selected during the special game circumstances. The function selector 24 may be arranged to randomly select a function or to select a function on the basis of a predefined rule.

The gaming system 10 also comprises an outcome generator 28 which in accordance with the game instructions 18 determines game outcomes based on the symbols selected for display to a player by the symbol selector 20, and on the basis of the function(s) allocated to one or more selected symbols, if any.

In the embodiments described below, the symbol selector 20, the function selector 24, the function allocator 26, and the outcome generator 28 are at least partly implemented using a microprocessor, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 2:
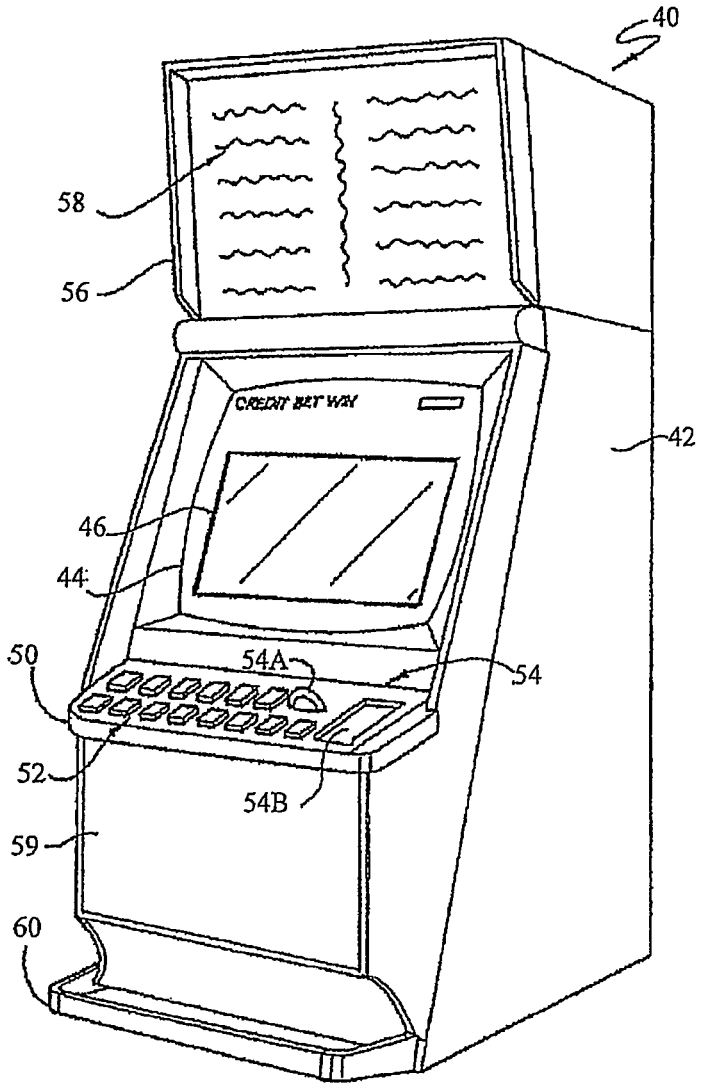
FIG. 2 is a diagrammatic representation of a gaming system in accordance with an embodiment of the present invention with the gaming system implemented in the form of a stand alone gaming machine.

A gaming system in the form of a stand alone gaming machine 40 is illustrated in FIG. 2. The gaming machine 40 includes a console 42 having a display 44 on which is displayed representations of a game 46 that can be played by a player. A mid-trim 50 of the gaming machine 40 houses a bank of buttons 52 for enabling a player to interact with the gaming machine, in particular during gameplay. The mid-trim 50 also houses a credit input mechanism 54 which in this example includes a coin input chute 54A and a bill collector 54B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 56 may carry artwork 58, including for example pay tables and details of bonus awards and other information or images relating to the game. Further artwork and/or information may be provided on a front panel 59 of the console 42. A coin tray 60 is mounted beneath the front panel 59 for dispensing cash payouts from the gaming machine 40.

The display 44 is in the form of a video display unit, particularly a cathode ray tube screen device. Alternatively, the display 44 may be a liquid crystal display, plasma screen, any other suitable video display unit. The top box 56 may also include a display, for example a video display unit, which may be of the same type as the display 44, or of a different type.

The display 44 in this example is arranged to display representations of several reels, each reel of which has several associated symbols. Typically 3, 4 or 5 reels are provided. During operation of the game, the reels first appear to rotate then stop with typically three symbols visible on each reel. Game outcomes are determined on the basis of the visible symbols together with any special functions associated with the symbols.

It will be understood that instead of providing a video display unit which displays representations of reels, actual reels may be used. Such gaming machines including actual rotatable reels are commonly termed stepper machines.

Figure 3:
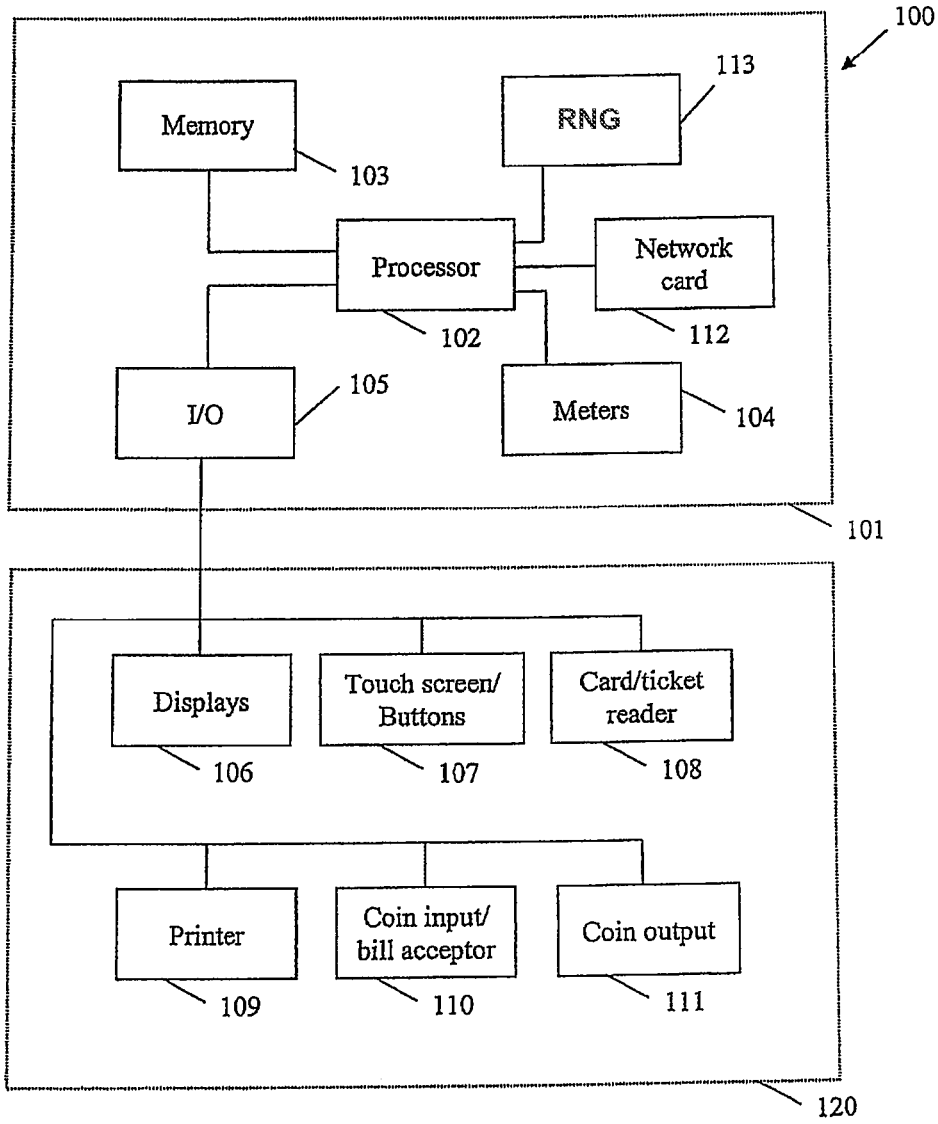
FIG. 3 is a schematic block diagram of operative components of the gaming machine shown in FIG. 2.

FIG. 3 shows a block diagram of operative components of a typical gaming machine 100 which may be the same as or different to the gaming machine shown in FIG. 2.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 4:
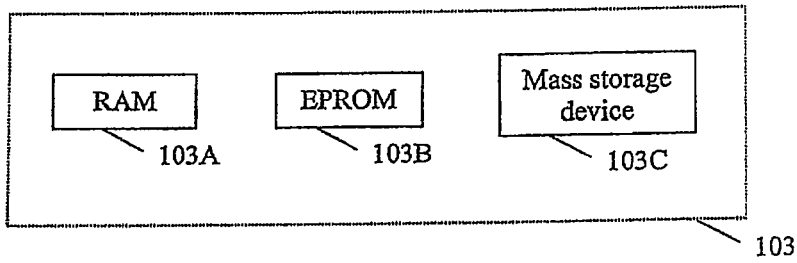
FIG. 4 is a schematic block diagram of components of a memory of the gaming machine shown in FIG. 2.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 3, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

Figure 5:
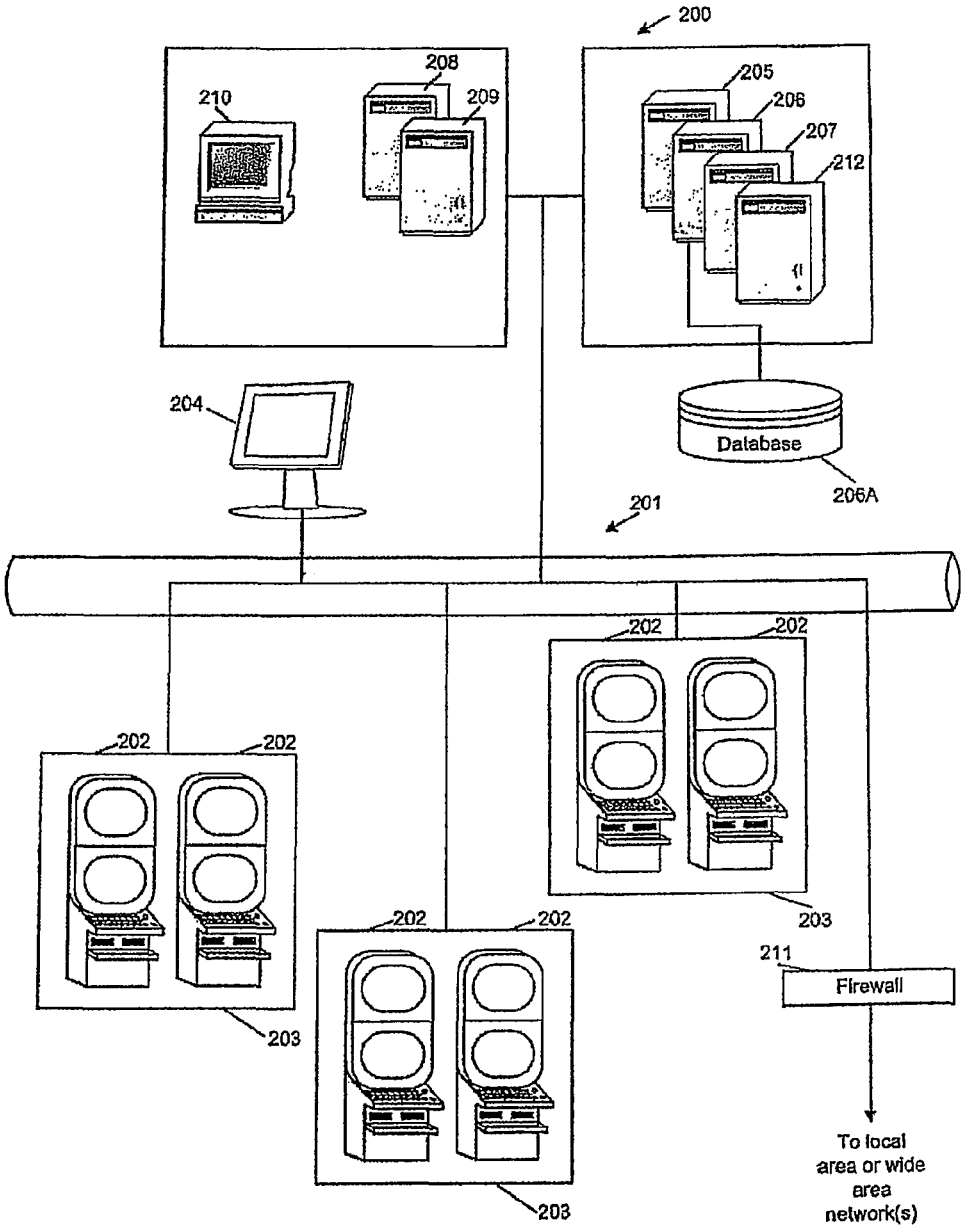
FIG. 5 is a schematic diagram of a gaming system in accordance with an alternative embodiment of the present invention with the gaming system implemented over a network.

FIG. 5 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 40, 100 or over a network 201, implements a probabilistic game wherein at least some functions which contribute to game outcomes are allocatable during game play.

Examples of specific implementations of the gaming system will now be described in relation to a stand alone gaming machine 40, 100, although it will be understood that implementation may also be carried out using other gaming system architectures such as a network architecture of the type shown in FIG. 5.

Figure 8:
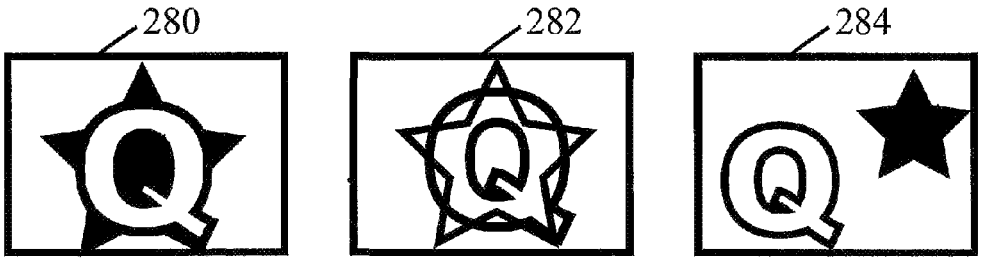
FIG. 8 is a diagrammatic representation of example symbols displayed by a gaming system in accordance with an embodiment of the present invention.
Figure 9:
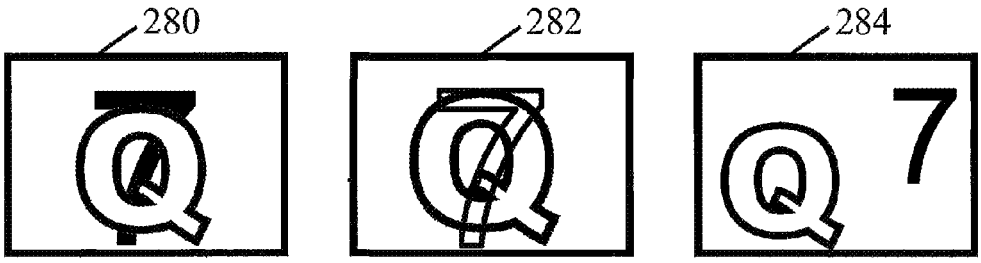
FIG. 9 is a diagrammatic representation of example symbols displayed by a gaming system in accordance with an embodiment of the present invention.

In one embodiment, reels comprising standard symbols are provided, at least some of the standard symbols having an additional special symbol incorporated into the standard symbol as a background symbol, a superimposed symbol or a double symbol as illustrated by first, second and third symbols 280, 282 and 284 respectively in FIG. 8. In one variation shown in FIG. 9, the special symbol is a number incorporated into a standard symbol.

Win outcomes are determined on the basis of the symbols visible when the reels stop rotating, and in this example three symbols are displayed on each reel at any time. A win outcome may occur based on occurrence of the same symbol along a horizontal or diagonal line, as scattered symbols, or in any other predefined way. A win outcome may also occur on the basis of one or more standard symbols in combination with at least one function symbol having a predefined dedicated function. For example a function symbol may correspond to a wild function, a scatter function, a multiply function, a repeat win function, and so on.

During special game mode, or in some embodiments during normal game play, one or more symbols are selected to acquire a function. In some embodiments, the selected symbol is chosen from symbols shown on the display 106. In other embodiments, the selected symbol is chosen from all available symbols and, as such, the selected symbol may not be shown on the display and allocation of a function to the selected symbol will as a consequence not necessarily affect the outcome of the game.

In the present embodiment, a new function allocated to a symbol is communicated to a player by separately displaying a representation of a special symbol on the gaming machine 40, 100. For example, with the example shown in FIG. 8, the standard symbol is a queen and the special symbol is a star and allocation of a function to the standard symbol may be communicated to a player by separately displaying a star on the gaming machine 40, 100. During a game, when the star is separately displayed on the gaming machine, one or more queen symbols having an incorporated star symbol acquire the function associated with the star.

It will be understood that allocation of a new function to a symbol may be communicated to a player in other ways including displaying a message on a player tracking module, displaying a message on a credit meter device, or in any other suitable way.

For example, allocation of a new function to a symbol may be communicated to a player by modifying the appearance of a symbol, such as by animating the symbol, changing the colour of the symbol, and so on.

In an embodiment wherein at least some symbols include a number incorporated into the symbol, allocation of a new function to a symbol may be communicated to a player by displaying a number, which may be pseudo randomly selected. With this embodiment, all symbols which have a number which accords to a particular relationship may be caused to acquire a function. The relationship may be that the displayed number is the same as, greater than, or less than the number incorporated into the symbol.

In a stepper machine implementation, allocation of a new function to a symbol may be communicated to a player by emphasising a displayed symbol, for example by illuminating the displayed symbol at an increased intensity relative to other displayed symbols, by illuminating a selected symbol with light of a different colour to other displayed symbols, and so on.

It will also be understood that a function may be applied to all standard symbols having the corresponding incorporated special symbol, to such standard symbols in one or more specific reels, to such standard symbols in progressively increasing numbers of reels with successive games, or in any other predefined way.

It will also be understood that a function may be allocated to a selected symbol for one game, with the symbol returning to its normal significance for subsequent games, or the function may by allocated to a selected symbol for multiple successive games.

It will also be understood that more than one function may be assigned to one or more standard symbols in a game or progressively in successive games. For example, in a first game, a first function may be allocated to at least one standard symbol by separately displaying a first special symbol associated with the first function, and in a second successive game a second function may be assigned to at least one standard symbol by separately displaying a second special symbol associated with the second function.

In a further variation, a second function is assigned to a standard symbol located immediately adjacent the standard symbol associated with the first function. This is commonly termed "stacking".

Furthermore, it will be understood that a function may be allocatable to a standard symbol in all games or functions may be allocatable to standard symbols only when the gaming system operates in a special game mode. The gaming system may be arranged to commence special game mode when predetermined game outcomes occur and special game mode may comprise one or more free games, in this example three free games. Special game mode may commence automatically on the basis of game outcomes determined by the gaming system, or may be prompted by a player pressing a button on the gaming machine 40, 100 after the player has identified that a game outcome corresponding to special game mode requirements has occurred.

Special game mode may be triggered or selection of a symbol to acquire a function may be triggered by appearance of a trigger symbol or appearance of particular graphical indicia, in this example a representation of a woman, on the display. When this occurs, a symbol to acquire a function is selected and the function is allocated to one or more of the selected symbol(s). If more than one trigger symbol or graphical indicia appears on the display, a corresponding number of symbols to acquire a function may be selected.

Figure 6:
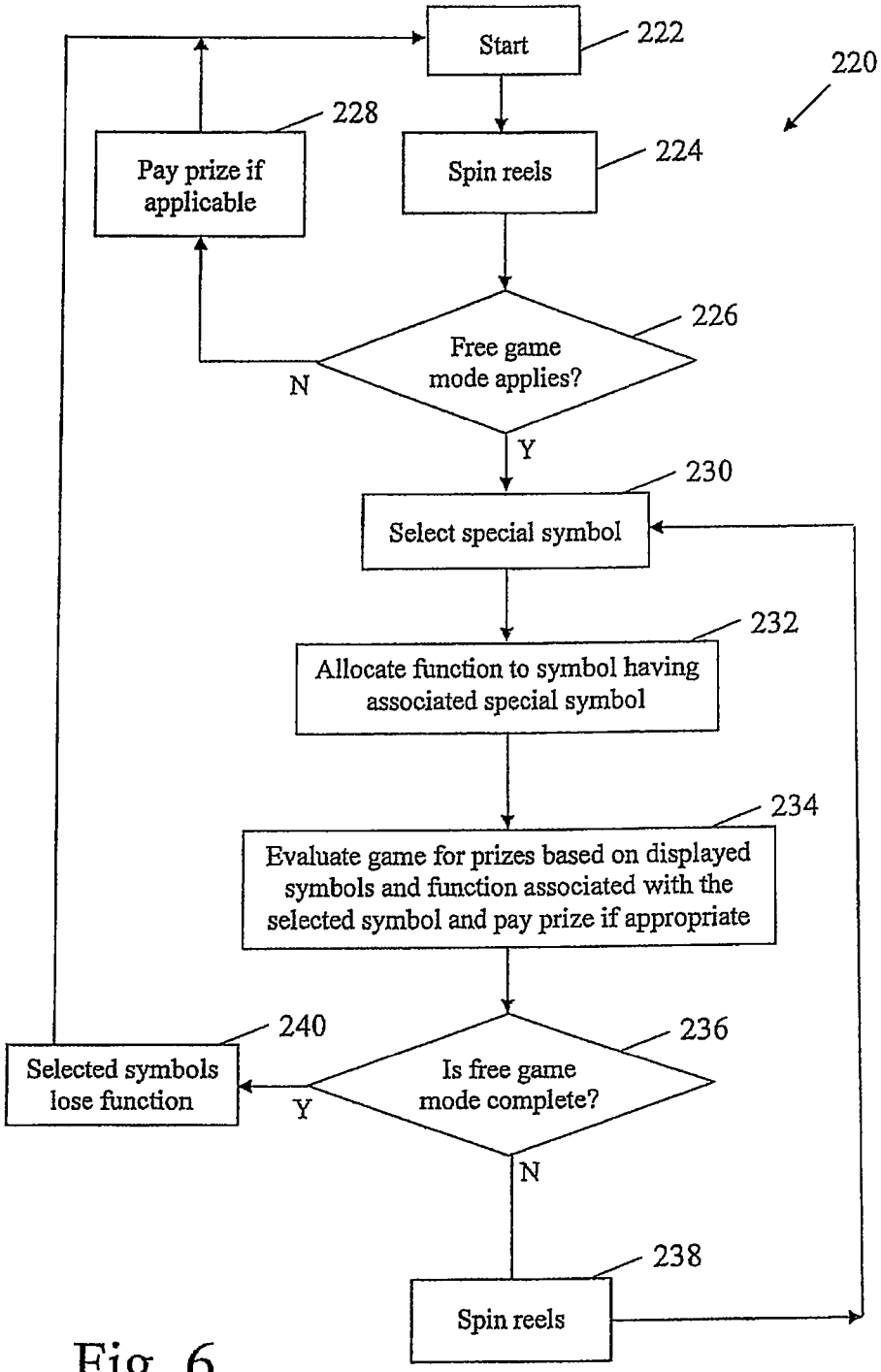
FIG. 6 is a flow diagram illustrating game play of a gaming system in accordance with an embodiment of the present invention.

A specific example will now be described in relation to flow diagram 220 shown in FIG. 6 which illustrates steps 220 to 240 of a method of gaming implemented by the gaming system according to the present embodiment.

In this example, three reels are provided with each reel having two 9 symbols, two queen symbols, two king symbols, one jack symbol and a wild symbol. One of the 9 symbols has a first special symbol which for example may be in the form of a background star of the type shown by the first symbol 280 in FIG. 8, one of the kings has a second special symbol which may for example be a superimposed star of the type shown by the second symbol 282 in FIG. 8, and one of the queens has a third special symbol which may be a separate star of the type shown by the third symbol 284 in FIG. 8. The first, second and third special symbols have respective associated first, second and third functions.

The game operates such that during normal game mode no additional function is applied to the symbols on the reels; that is, the first, second and third functions associated with the first, second and third special symbols are not applied and are not taken into consideration when a game outcome is assessed by the game controller.

Normal game mode continues until a predetermined game outcome occurs which is recognized by the processor 102 and which triggers commencement of a special game mode. In this example, the predetermined outcome is scattered displayed kings, although other predetermined outcomes which trigger special game mode are envisaged, such as eligibility for re-spin games, eligibility for hold and spin games, eligibility for repeat win games, eligibility for special prize schedules, and ante bet.

When special game mode is triggered, the processor 102 in association with the random number generator 113 selects one of the special symbols and displays the selected special symbol on the display 106, and the function associated with the special symbol is applied to the or each standard symbol incorporating the selected special symbol. The game outcome is then determined by the processor 102 based on the displayed standard symbols and on the function associated with any displayed special symbol. In the event of a win outcome, a prize is paid to the player.

In a second free game, in addition to the first special symbol, a second special symbol is also displayed on the display 106 and the game outcome is determined by the processor 102 based on the displayed standard symbols and any additional function associated with the displayed first and second special symbols.

Similarly with a third free game, a third special symbol is displayed on the display 106 and the game outcome is determined based on the displayed standard symbols and any additional function associated with displayed first, second and third special symbols.

While the above example is in the form of a stepper machine with actual reels, it will be understood that a similar implementation can be achieved using a video based gaming system. With this variation, instead of permanently providing some of the symbols with incorporated special symbols, the special symbols may be dynamically added or removed as determined by the game controller. This embodiment also allows incorporation of special symbols into standard symbols on the reels to be achieved in other ways such as by alternately displaying standard and special symbols in the same location on a virtual reel.

In a second embodiment, a function is allocated to a symbol by nominating a standard symbol and allocating a new function to the standard symbol.

As with the first embodiment described above, game outcomes are determined by the processor 102 on the basis of the symbols visible when the reels stop rotating, and a win outcome may occur based on display of the same symbol along a horizontal or diagonal line, as scattered symbols, or in any other predefined way.

In the present embodiment, a new function is allocated to a symbol by separately displaying a representation on the display 106 of the gaming machine 40, 100 of one or more of the standard symbols. For example, if the standard symbols include a 9, a jack, a queen, a king and a wild symbol, a function may be allocated to the 9 symbol by separately displaying the 9 symbol on the gaming machine. During a game, when the 9 symbol is separately displayed, one or more 9 symbols acquire the function associated with the 9 symbol and game outcomes are determined by the processor 102 on the basis of the positions of the standard symbols and on the function associated with the 9 symbol.

It will be understood that a function may be applied to all standard symbols corresponding to the nominated symbol, to corresponding standard symbols in one or more specific reels, to corresponding standard symbols in progressively increasing numbers of reels with successive games, or in any other predefined way.

It will also be understood that more than one function may be assigned to one or more standard symbols in a game or progressively in successive games. For example, in a first game a first function may be allocated to one or more symbols, and in a second successive game a second function may be assigned to one or more symbols.

Furthermore, as with the first embodiment, it will be understood that a function may be allocatable to a symbol in all games or functions may be allocatable to standard symbols only when the gaming system operates in a special game mode. The gaming system may be arranged to commence special game mode when predetermined game outcomes occur and special game mode may comprise one or more free games.

Figure 7:
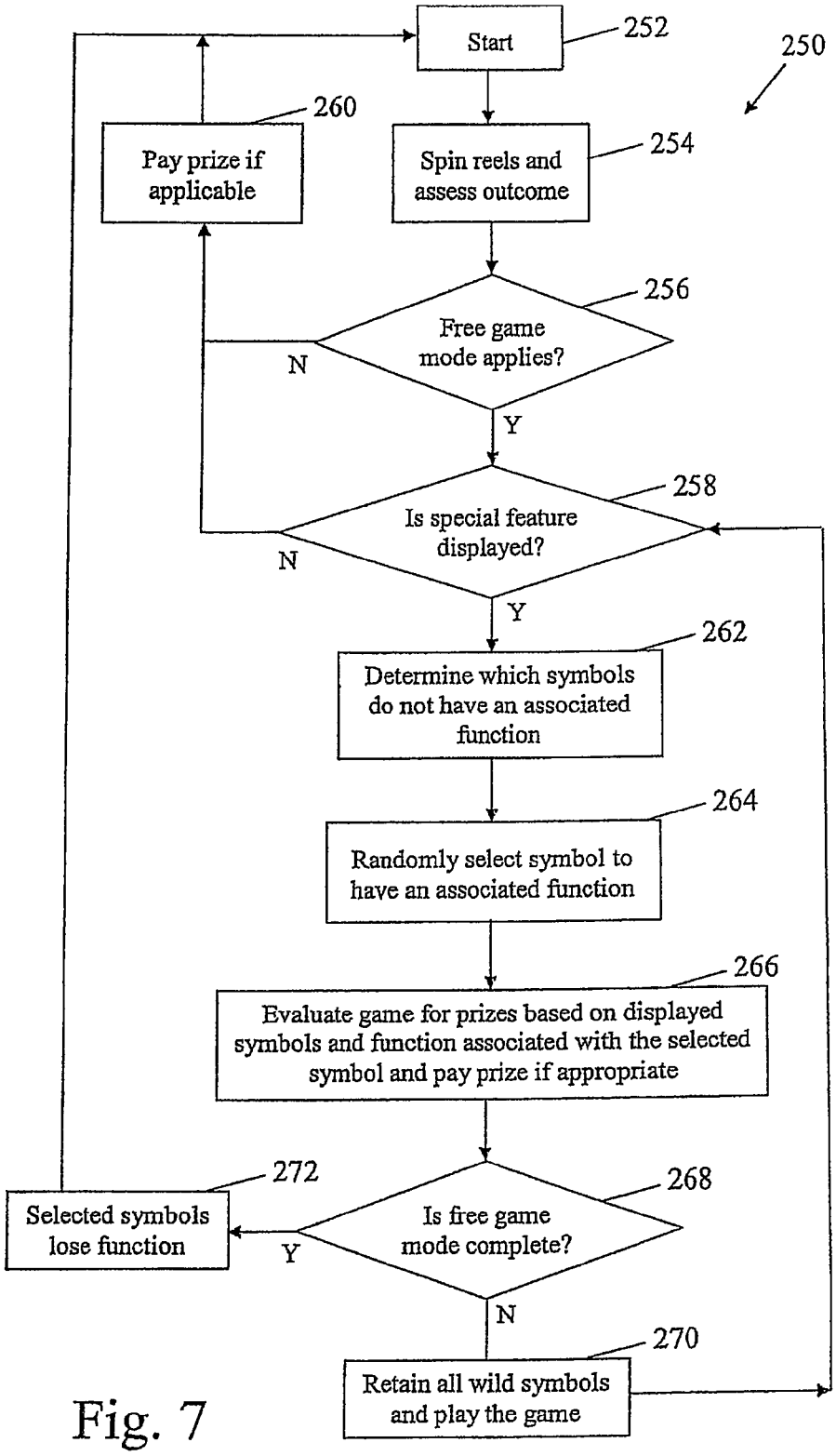
FIG. 7 is a flow diagram illustrating game play of a gaming system in accordance with an alternative embodiment of the present invention.

A specific example will now be described in relation to flow diagram 250 shown in FIG. 7 which illustrates steps 252 to 272 of a method of gaming implemented by the gaming system according to the present embodiment.

In this example, five reels are provided with each reel having 9, 10, jack, queen, king, wild and cat symbols.

The game operates such that during normal game mode no additional function is applied to the symbols on the reels.

Normal game mode continues until a predetermined game outcome occurs which triggers commencement of special game mode. In this example, the predetermined outcome is scattered cats, although other predetermined outcomes which trigger special game mode are envisaged.

When special game mode is triggered, the game controller communicates to the player that special game mode is being played, in this example by displaying the words "Call of the Wild". During special game mode, whenever a wild symbol appears in the visible display, another symbol is nominated to acquire a function, in this example a wild function, for the duration of the remaining free games. The process of choosing which symbol is to acquire a wild function is carried out by the game controller, in particular by the processor in association with the random number generator 113.

For example, if during a free game a wild symbol is displayed, the game controller randomly selects a symbol other than a wild symbol, for example a queen, and all queens then acquire a wild function. The game outcome is then determined based on the displayed symbols and the wild function assigned to the queen symbols. In the event of a win outcome a prize is paid to the player.

During a subsequent free game, the wild function assigned to the queen symbols may be retained and, if a wild symbol is again displayed when the reels stop, the game controller randomly selects a different symbol to acquire a function, for example a jack symbol. The game outcome is then determined based on the displayed symbols and the wild functions assigned to the jack and queen symbols.

In a further subsequent free game, if no wild symbols are displayed when the reels stop, the wild functions assigned to the jack and queen symbols are retained, but no further functions are assigned to the symbols.

After completion of the free games, normal mode resumes and the functions assigned to the jack and queen symbols are removed.

It will be understood that a function may be assigned to a symbol whenever symbols other than a wild symbol are displayed on the gaming machine 40, 100. For example, display of a scatter symbol may trigger the game controller 101 to select a symbol to acquire a wild function or to acquire other functions such as a scatter function.

It will also be understood that a function may be assigned to a symbol based on other conditions occurring during special game mode. For example, a function may be assigned to a symbol whenever a predetermined symbol is visible on a secondary display, is in a winning combination, is in a non-winning combination, is visible with another predetermined symbol, is visible when another predetermined symbol is not visible, or is not visible on the game machine display 106.

It will also be understood that instead of carrying out random selection of a symbol to acquire a function by the game machine 40, 100, the selection may be made by gaming machine in a predefined sequence, by the player, by an external system or operator, or by another player.

Modifications and variations as would be apparent to a skilled addressee are deemed to be within the scope of the present invention.

Those skilled in the relevant arts will appreciate that modifications and additions to the embodiments of the present invention may be made without departing from the scope of the present invention.

It will be understood that the invention disclosed and defined in this specification extends to all alternative combinations of two or more of the individual features mentioned or evident from the text or drawings. All of these different combinations constitute various alternative aspects of the invention.

It will also be understood that the term "comprises" (or its grammatical variants) as used in this specification is equivalent to the term "includes" and should not be taken as excluding the presence of other elements or features.

The invention claimed is:

1. A gaming system, comprising:

a display configured to visually depict a plurality of symbols; and a game controller comprising a processor and a random number generator, wherein the processor is configured to randomly select, based on one or more numbers generated by the random number generator, the plurality of symbols from a set of symbols that includes one or more symbols with a visually incorporated numeric special symbol, select a first function from a plurality of different functions, associate the first function to a selected numeric value, allocate the first function to any symbol of the set of symbols with a visually incorporated numeric special symbol having a predetermined relationship to the selected numeric value, and determine a game outcome based on the selected plurality of symbols and the first function allocated to any symbol of the selected plurality of symbols;

wherein the game controller is further configured to allocate the first function when a predefined trigger condition exists.

2. A gaming system as claimed in claim 1, wherein the numeric special symbol is incorporated with a base symbol as a background symbol, a superimposed symbol, a double symbol, or by alternately displaying the base symbol and the numeric special symbol.

3. A gaming system as claimed in claim 2, wherein the game controller is further configured to allocate the first function to all symbols of the set of symbols which have an incorporated numeric special symbol that depicts a numeric value greater than the selected numeric value.

4. A gaming system as claimed in claim 2, wherein the game controller is further configured to allocate the first function to all symbols of the set of symbols which have an incorporated numeric special symbol that depicts a numeric value less than the selected numeric value.

5. A gaming system as claimed in claim 1, wherein the game controller is further configured to allocate the first function for one game.

6. A gaming system as claimed in claim 1, wherein the game controller is further configured to allocate the first function for multiple successive games.

7. A gaming system as claimed in claim 1, wherein the predefined trigger condition is display of a predefined trigger symbol, or display of predefined graphical indicia.

8. A gaming system as claimed in claim 7, wherein the predefined trigger symbol is a function symbol and the game controller is further configured to allocate a function associated with the function symbol when the function symbol is displayed.

9. A gaming system as claimed in claim 1, wherein the game controller is further configured to allocate a function of the plurality of different functions to one or more symbols in the set of symbols.

10. A gaming system as claimed in claim 9, wherein:

the display comprises a plurality of rotatable physical reels, wherein each reel carries symbols from the set of symbols; and the game controller is configured to initiate and stop spinning of the plurality of rotatable physical reels to cause the display to visually depict the plurality of symbols.

11. A gaming system as claimed in claim 1, wherein the game controller is further configured to progressively increase a number of symbols with incorporated numeric special symbols with successive games.

12. A gaming system as claimed in claim 1, wherein the plurality of different functions comprise a wild function, a scatter function, a repeat win function, a multiplier function, a jackpot function, and a feature commencement function.

13. A gaming system as claimed in claim 1, wherein the gaming system is implemented as a stand alone gaming machine or across a network.

14. The gaming system as claimed in claim 1, wherein the display is further configured to visually depicted the selected numeric value.

15. A gaming system, comprising:

a credit input device configured to receive credits;

a display configured to visually depict a plurality of symbols; and a game controller comprising a hardware meter, a random number generator, and a processor, wherein the hardware meter is configured to monitor credits and the processor is configured to randomly select, based on a number generated by the random number generator, the plurality of symbols from a set of symbols that includes one or more symbols with a visually incorporated numeric special symbol, select a first function from a plurality of different functions, associate the first function to a selected numeric value, allocate the first function to any symbol of the set of symbols with a visually incorporated numeric special symbol having a predetermined relationship to the selected numeric value, and determine a game outcome based on the selected plurality of symbols and the first function allocated to any symbol of the selected plurality of symbols;

wherein the game controller is further configured to allocate the first function in response to operating in a special game mode.

16. A gaming system as claimed in claim 15, wherein the game controller is further configured to commence the special game mode when a predetermined game outcome occurs.

17. A gaming system as claimed in claim 15, wherein the numeric special symbol is incorporated with a base symbol as a background symbol, a superimposed symbol, a double symbol, or by alternately displaying the base symbol and the numeric special symbol.

18. A gaming system as claimed in claim 17, wherein the game controller is further configured to allocate the first function to all symbols of the set of symbols which have an incorporated numeric special symbol that depicts a numeric value greater than the selected numeric value.

19. A gaming system as claimed in claim 17, wherein the game controller is further configured to allocate the first function to all symbols of the set of symbols which have an incorporated numeric special symbol that depicts a numeric value less than the selected numeric value.

20. A gaming system as claimed in claim 15, wherein the game controller is further configured to allocate the first function for one game.

21. A gaming system as claimed in claim 15, wherein the game controller is further configured to allocate the first function for multiple successive games.

22. A gaming system as claimed in claim 15, wherein:

the display comprises a plurality of rotatable physical reels, wherein each reel carries symbols from the set of symbols; and the game controller is configured to initiate and stop spinning of the plurality of rotatable physical reels to cause the display visually depict the plurality of symbols.

23. A gaming system as claimed in claim 15, wherein the game controller is further configured to progressively increase a number of symbols with incorporated numeric special symbols with successive games.

24. A gaming system as claimed in claim 15, wherein the plurality of different functions comprise a wild function, a scatter function, a repeat win function, a multiplier function, a jackpot function, and a feature commencement function.

25. The gaming system as claimed in claim 15, wherein the display is further configured to visually depicted the selected numeric value.

26. A method of gaming using a gaming system having a display, the method comprising:

randomly selecting the plurality of symbols from a set of symbols that includes one or more symbols with a visually incorporated numeric special symbol;

spinning a plurality of physical reels that each carry symbols from the set of symbols;

stopping the plurality of physical reels such that the plurality of physical reels depict the plurality of symbols that were randomly selected;

selecting a first function from a plurality of different functions;

associating the first function to a first selected numeric value;

allocating the first function to any symbol of the set of plurality of symbols with a visually incorporated numeric special symbol having a first predetermined relationship to the first selected numeric value;

selecting a second function from the plurality of different functions;

associating the second function to a second selected numeric value;

allocating the second function to any symbol of the set of symbols with a visually incorporated numeric special symbol having a second predetermined relationship to the second selected numeric value; and determining a game outcome based on the selected plurality of symbols and the first and second functions allocated to any symbols of the selected plurality of symbols;

wherein said allocating the first function comprises allocating the first function when a predefined trigger condition exists.

27. A method as claimed in claim 26, wherein the step of allocating the first function comprises allocating the first function to at least one symbol of the selected plurality of symbols.

28. A method as claimed in claim 26, the numeric special symbol is incorporated with a base symbol as a background symbol, a superimposed symbol, a double symbol, or by alternately displaying the base symbol and the numeric special symbol.

29. A method as claimed in claim 28, further comprising allocating the first function to all symbols of the set of symbols which have an incorporated numeric special symbol that depicts a numeric value greater than the first selected numeric value.

30. A method as claimed in claim 28, further comprising allocating the first function to all symbols of the set of symbols which have an incorporated numeric special symbol that depicts a numeric value less than the first selected numeric value.

31. A method as claimed in claim 26, wherein said allocating the first function comprises allocating the first function for one game.

32. A method as claimed in claim 26, wherein said allocating the first function comprises allocating the first function for multiple successive games.

33. A method as claimed in claim 26, wherein the predefined trigger condition is display of a predefined trigger symbol, or display of predefined graphical indicia.

34. A method as claimed in claim 26, wherein the plurality of different functions comprise a wild function, a scatter function, a repeat win function, a multiplier function, a jackpot function, and a feature commencement function.

35. The method as claimed in claim 26, further comprising visually depicting the first selected numeric value.

36. A method of gaming using a gaming system having a display, the method comprising:

receiving credits via a credit input device;

monitoring credits via a hardware meter;

visually depicting on the display a plurality of symbols;

randomly selecting, based on a number generated by a random number generator, the plurality of symbols from a set of symbols that includes one or more symbols with a visually incorporated numeric special symbol;

selecting a first function from a plurality of different functions;

associating the first function to a first selected numeric value;

allocating the first function to any symbol of the set of plurality of symbols with a visually incorporated numeric special symbol having a first predetermined relationship to the first selected numeric value;

selecting a second function from the plurality of different functions;

associating the second function to a second selected numeric value;

allocating the second function to any symbol of the set of symbols with a visually incorporated numeric special symbol having a second predetermined relationship to the second selected numeric value; and determining a game outcome based on the selected plurality of symbols and the first and second functions allocated to any symbols of the selected plurality of symbols;

wherein said allocating the first function comprises allocating the first function in response to a special game mode.

37. A method as claimed in claim 36, further comprising commencing the special game mode when a predetermined game outcome occurs.

38. A method as claimed in claim 36, wherein the step of allocating the first function comprises allocating the first function to at least one symbol of the selected plurality of symbols.

39. A method as claimed in claim 36, the numeric special symbol is incorporated with a base symbol as a background symbol, a superimposed symbol, a double symbol, or by alternately displaying the base symbol and the numeric special symbol.

40. A method as claimed in claim 39, further comprising allocating the first function to all symbols of the set of symbols which have an incorporated numeric special symbol that depicts a numeric value greater than the first selected numeric value.

41. A method as claimed in claim 40, further comprising allocating the first function to all symbols of the set of symbols which have an incorporated numeric special symbol that depicts a numeric value less than the first selected numeric value.

42. A method as claimed in claim 36, wherein said allocating the first function comprises allocating the first function for one game.

43. A method as claimed in claim 36, wherein said allocating the first function comprises allocating the first function for multiple successive games.

44. A method as claimed in claim 36, wherein said visually depicting comprises stopping a plurality of spinning physical reels that carry symbols from the set of symbols, wherein the stopped plurality of physical reels visually depict the plurality of symbols.

45. A method as claimed in claim 36, wherein the plurality of different functions comprise a wild function, a scatter function, a repeat win function, a multiplier function, a jackpot function, and a feature commencement function.

46. The method as claimed in claim 36, further comprising visually depicting the first selected numeric value.

47. A computer readable device having computer readable program code encoded with a set of instructions for execution on a gaming system having a display and associated processing logic for randomly displaying a plurality of symbols from a set of symbols, wherein, in response to executing the set of instructions, the gaming system is configured to:

visually depict on the display the plurality of symbols;

randomly select, based on a number generated by a random number generator, the plurality of symbols from a set of symbols that includes one or more symbols with a visually incorporated numeric special symbol;

select a first function from a plurality of different functions;

associate the first function with a first selected numeric value;

allocate, when a predefined trigger condition exists, the first function to any symbol of the set of plurality of symbols with a visually incorporated numeric special symbol having a first predetermined relationship to the first selected numeric value;

select a second function from the plurality of different functions;

associate the second function with a second selected numeric values;

allocate the second function to any symbol of the set of symbols with a visually incorporated numeric special symbol having a second predetermined relationship to the second selected numeric value; and determine a game outcome based on the selected plurality of symbols and the first and second functions allocated to any symbols of the selected plurality of symbols.

48. A computer readable device as claimed in claim 47, wherein the gaming system, in response to executing the set of instructions, is further configured to detect the predefined trigger condition as a display of a predefined trigger symbol or a display of predefined graphical indicia.

49. A computer readable device having computer readable program code encoded with a set of instructions for execution on a gaming system having a display and associated processing logic for randomly displaying a plurality of symbols from a set of symbols, wherein, in response to executing the set of instructions, the gaming system is configured to:

randomly select, based on a number generated by a random number generator, the plurality of symbols from a set of symbols that includes one or more symbols with a visually incorporated numeric special symbol;

spin a plurality of physical reels that each carry symbols from the set of symbols;

stop the plurality of physical reels such that the plurality of physical reels depict the plurality of symbols that were randomly selected;

select a first function from a plurality of different functions;

associate the first function with a first selected numeric value;

allocate, in response to a special game mode, the first function to any symbol of the set of plurality of symbols with a visually incorporated numeric special symbol having a first predetermined relationship to the first selected numeric value;

select a second function from the plurality of different functions;

associate the second function with a second selected numeric values;

allocate the second function to any symbol of the set of symbols with a visually incorporated numeric special symbol having a second predetermined relationship to the second selected numeric value; and determine a game outcome based on the selected plurality of symbols and the first and second functions allocated to any symbols of the selected plurality of symbols.

50. A computer readable device as claimed in claim 49, wherein the gaming system, in response to executing the set of instructions, is further configured to commence the special game mode when a predetermined game outcome occurs.

* * * * *